US006185738B1

(12) United States Patent
Sidebottom

(10) Patent No.: US 6,185,738 B1
(45) Date of Patent: Feb. 13, 2001

(54) TACTICAL LOAD-BEARING PROTECTIVE VEST

(75) Inventor: Betty A. Sidebottom, Littleton, CO (US)

(73) Assignee: SITE Enterprises of Colorado, Inc., Littleton, CO (US)

( * ) Notice: Under 35 U.S.C. 154(b), the term of this patent shall be extended for 0 days.

(21) Appl. No.: 09/268,829

(22) Filed: Mar. 16, 1999

(51) Int. Cl.[7] ..... F41M 1/02; F41M 1/04

(52) U.S. Cl. ..... 2/2.5; 2/94; 2/102; 89/36.05

(58) Field of Search ..... 2/2.5, 455, 462–463, 2/467, 94, 102, 247–253, 920; 89/36.05

(56) References Cited

U.S. PATENT DOCUMENTS

| | | | | |
|---|---|---|---|---|
| 1,239,578 | * | 9/1917 | Dubinsky | 2/253 |
| 2,967,307 | * | 1/1961 | O'Donnell | 2/253 |
| 3,452,362 | * | 7/1969 | Korolick et al. | 2/2.5 |
| 3,557,384 | * | 1/1971 | Barron et al. | 2/2.5 |
| 4,106,121 | | 8/1978 | Belson . | |
| 4,507,802 | * | 4/1985 | Small | 2/2.5 |
| 4,522,871 | | 6/1985 | Armellino, Jr. et al. . | |
| 4,805,241 | | 2/1989 | Faccini . | |

(List continued on next page.)

FOREIGN PATENT DOCUMENTS

2699265 * 6/1994 (FR) .

OTHER PUBLICATIONS

"Ranger Joe's Military and Law Enforcement Gear" Catalog, Fall 1999; Tactical Load Bearing Vests, pp. 38 & 42; Ranger Joe's International, 325 Farr Road, Suite A, Columbus, GA 31907.

*Primary Examiner*—John J. Calvert
*Assistant Examiner*—Tejash Patel
(74) *Attorney, Agent, or Firm*—John L. Isaac; Isaac & Associates

(57) ABSTRACT

A load-bearing protective vest is provided and is adapted to selectively carry detachable elements such as supply receptacles and other auxiliary items. The vest is in the form of a unitary member having a front panel, a rear panel and a central panel interconnecting the front and rear panels. Each panel has at least a first inner layer of durable abrasion-resistant material for positioning against the body of a user and a second outer layer of durable abrasion-resistant material. The central panel defines a center opening sized and shaped for receiving a human head therethrough and a pair of shoulder support straps disposed on each side of the center opening adapted to support a load imposed by the vest during use thereof. A layer of attachment fabric in the form of hook-and-loop type fastening members covers a substantial portion of the outer surface of the second outer layer material of each of the front and rear panels, the detachable elements carrying complementary hook-and-loop type fastening members. A plurality of individual fastening members are spaced across a substantial portion of the attachment fabric in operative relation therewith for selective placement and attachment of the detachable elements to the outer surface of the vest. The front panel has a first interior compartment defined between the first and second layers of material, the first compartment being accessible through a first vest opening. The rear panel similarly has a second interior compartment defined between the first and second layers of material, the second compartment being accessible through a second vest opening. A plurality of individual pouches are secured within the first compartment and are accessible through the first vest opening, and a plurality of individual pouches are likewise secured within the second compartment and are accessible through the second vest opening. The pouches in the first and second compartments are sized and shaped for selectively receiving assorted ballistic-resistant body armor elements for providing ballistic protection to a user of the vest.

31 Claims, 3 Drawing Sheets

U.S. PATENT DOCUMENTS

| | | | | |
|---|---|---|---|---|
| 5,008,959 | | 4/1991 | Coppage, Jr. et al. . | |
| 5,024,360 | | 6/1991 | Rodriguez . | |
| 5,060,314 | | 10/1991 | Lewis . | |
| 5,211,321 | | 5/1993 | Rodriguez . | |
| 5,245,993 | | 9/1993 | McGrady et al. . | |
| 5,265,782 | | 11/1993 | McNamara . | |
| 5,306,557 | | 4/1994 | Madison . | |
| 5,331,683 | * | 7/1994 | Stone et al. | 2/2.5 |
| 5,373,582 | | 12/1994 | Dragone et al. . | |
| 5,479,659 | * | 1/1996 | Bachner | 2/2.5 |
| 5,495,620 | * | 3/1996 | Schoenweiss et al. | 2/2.5 |
| 5,495,621 | | 3/1996 | Kibbee . | |
| 5,617,582 | | 4/1997 | Burwell . | |
| 5,619,748 | | 4/1997 | Nelson et al. . | |
| 5,677,029 | | 10/1997 | Prevorsek et al. . | |
| 5,754,982 | | 5/1998 | Gainer . | |
| 5,763,813 | | 6/1998 | Cohen et al. . | |
| 5,771,488 | | 6/1998 | Honkala . | |
| 5,771,489 | | 6/1998 | Snedeker . | |
| 5,789,327 | | 8/1998 | Rousseau . | |
| 5,796,028 | | 8/1998 | Field et al. . | |
| 5,797,140 | | 8/1998 | Davis et al. . | |
| 5,799,329 | | 9/1998 | Hauschild . | |
| 5,804,015 | | 9/1998 | McCarter et al. . | |
| 5,804,757 | | 9/1998 | Wynne . | |
| 5,810,699 | | 9/1998 | Nadeau . | |
| 5,829,653 | | 11/1998 | Kaiser . | |
| 5,837,623 | | 11/1998 | Howland . | |
| 5,974,585 | * | 11/1999 | Bachner | 2/2.5 |

* cited by examiner

TACTICAL LOAD-BEARING PROTECTIVE VEST

BACKGROUND OF THE INVENTION

1. Field of the Invention

This invention relates generally to ballistic resistant garments and, more particularly, to load bearing tactical vests for police and military use. Specifically, the present invention relates to an improved load bearing protective vest that is adaptable to the ballistic and tactical requirements of an individual user.

2. Description of the Prior Art

Ballistic resistant garments and particularly vests have become standard equipment in law-enforcement offices and in the military. These vests are typically made of a fabric shell, usually of a woven material, and contain compartments in the form of pockets. Such vests generally fully encircled the torso of a wearer and include a plurality of panels of impact absorbing anti-ballistic material such as Kevlar, a registered trademark of E. I. Du Pont, Inc., or other soft body armor such as Spectra, a registered trademark of Allied Signal, Inc., and Twaron, a registered trademark of Akzo, Inc. Such vests are generally designed so that the torso of the wearer is surrounded, at least from the neck to the waist, with a layer of protective panels. These vests are commonly known by the public as bulletproof vests, and by the law-enforcement community as body armor, and the terms are used interchangeably. Such vests resist and usually prevent penetration by most small arms bullets when effectively worn.

Routine usage of these vests provides military personnel and law-enforcement officers a degree of protection from injury or death by firearms. Such regular or routine usage, however, subjects the law-enforcement officer to considerable inconvenience and discomfort. Such vests are commonly worn beneath the shirt of a standard uniform, and typical vest usage requires the law-enforcement officer to wear the vest throughout the entire workday, particularly on street duty. Examples of such vests are illustrated in U.S. Pat. Nos. 5,008,959, 5,373,582, 5,495,621, 5,619,748, 5,677,029 and 5,754,982. In certain special instances, however, domestic police forces charged with the responsibility of combating criminals have operated in special paramilitary groups. Such special teams of police are known as "Special Weapons and Tactics" (SWAT) squads and the like. In these instances, the standard or typical bulletproof vest is insufficient by itself.

In such special police or military operations, individuals have often found themselves in the position of fighting at close quarters. In such situations, there is an important need for quick access to ammunition, rations, auxiliary weapons, radios and ancillary supplies. These are generally carried by the individual close to the person's body to prevent entanglement with foliage or other items and to minimize the noise created by such objects. At the same time, it is desirable to permit ready access by the individual to any of the supplies even though he may be pinned down to the ground by weapons fire or by the need to camouflage himself. To accommodate these various needs, vests are often worn over the shirts of the individual, and the various items listed above are secured to the exterior of such vests. Examples of these types of vests are illustrated in U.S. Pat. Nos. 4,106,121, 5,060,314, 5,265,782, 5,617,582 and 5,797,140.

In these police operations, the responsibility of the police is to subdue the criminal and take him alive if possible. Such situations often arrive on short notice and dictate the requirement that the vest be operational with very little loss of time and efficiency. Furthermore, there is the need for close proximity of the policeman to the criminal. It is also desirable that such a vest fit snugly over the body with or without armor or with partial armor worn underneath. Typically, an officer will be required to wear a body armor vest or garment of some sort over which is placed an outer vest which carries the required equipment and supply receptacles. Thus, if a police or military officer desires to have several types of body armor in addition to a supply vest, the individual must frequently wear several layers of vests or garments to accomplish the desired end. This is uncomfortable and cumbersome. Therefore, there remains a distinct need to have a ballistic resistant vest or garment which is individually capable of incorporating different types of body armor or ballistic resistant items therein in accordance with the desires or needs of the individual wearing the vest in addition to having the capability of selectively positioning supply receptacles or other auxiliary items on the exterior of the vest in the manner desired by the particular needs and desires of the individual wearing the vest.

SUMMARY OF THE INVENTION

Accordingly, it is one object of the present invention to provide an improved load bearing protective tactical vest for police and military use.

It is another object of the present invention to provide a load bearing protective vest designed to carry a plurality of different types of ballistic resistant armor or items therein as desired and selected by the individual wearing the vest.

Yet another object of the present invention is to provide such a load bearing vest which is easy to put on and take off as well as adapted to permit variable placement of supply receptacles, auxiliary items and the like on the exterior of the vest.

Still another object of the present invention is to provide such a load bearing protective vest that is designed to be securely fastened about the body of a user in a manner that will prevent undesired shifting or movement of the vest from its designed position on the body of the user.

To achieve the foregoing and other objects and in accordance with the purpose of the present invention, as embodied and broadly described herein, a load-bearing protective vest is provided and is adapted to selectively carry detachable elements such as supply receptacles and other auxiliary items. The vest is in the form of a unitary member having a front panel, a rear panel and a central panel interconnecting the front and rear panels. Each panel has at least a first inner layer of durable abrasion-resistant material for positioning against the body of a user and a second outer layer of durable abrasion-resistant material. The central panel defines a center opening sized and shaped for receiving a human head therethrough and a pair of shoulder support straps disposed on each side of the center opening adapted to support a load imposed by the vest during use thereof. A layer of attachment fabric in the form of hook-and-loop type fastening members covers a substantial portion of the outer surface of the second outer layer material of each of the front and rear panels, the detachable elements carrying complementary hook-and-loop type fastening members. A plurality of individual fastening members are spaced across a substantial portion of the attachment fabric in operative relation therewith for selective placement and attachment of the detachable elements to the outer surface of the vest.

The front panel has a first interior compartment defined between the first and second layers of material, the first compartment being accessible through a first vest opening. The rear panel similarly has a second interior compartment defined between the first and second layers of material, the second compartment being accessible through a second vest opening. A plurality of individual pouches are secured within the first compartment and are accessible through the first vest opening, and a plurality of individual pouches are likewise secured within the second compartment and are accessible through the second vest opening. The pouches in the first and second compartments are sized and shaped for selectively receiving assorted ballistic-resistant body armor elements for providing ballistic protection to a user of the vest.

BRIEF DESCRIPTION OF THE DRAWINGS

The accompanying drawings which are incorporated in and form a part of the specification illustrate preferred embodiments of the present invention and, together with a description, serve to explain the principles of the invention. In the drawings.

DETAILED DESCRIPTION OF THE PREFERRED EMBODIMENT

Figure 1:
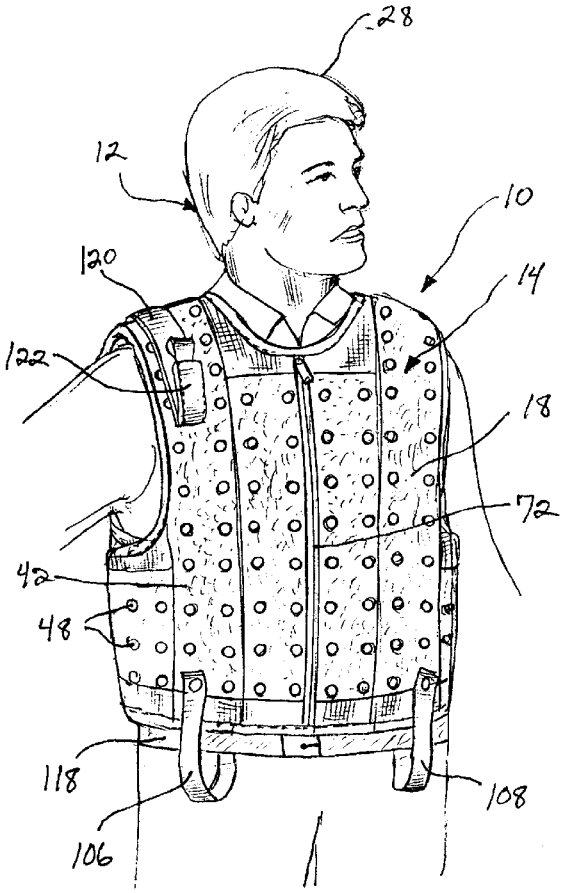
FIG. 1 is a front perspective view of one embodiment of a vest constructed in accordance with the present invention and illustrating the vest in a fully attached position on an individual wearer.

Referring first to FIGS. 1–4, a load bearing protective vest 10 is illustrated in position about an individual wearer or user 12. The vest 10 is preferably in the form of a unitary, poncho-like member having an outer surface 14 and an inner surface 16. In preferred form, the unitary member 10 is made up of a front panel portion 18, a rear panel portion 20 and a central panel portion 22 interconnecting the front and rear panels 18, 20. The front panel portion 18 is sized and shaped to fit across the chest area of a wearer 12 while the rear panel portion 20 is sized and shaped to fit across the back of a wearer. The central panel portion 22 is sized and shaped to cover the shoulder portions of the wearer 12. The unitary member 10, i.e. each of the panel portions 18, 20 and 22, is preferably made up of a first inner layer of durable abrasion-resistant material to form the inner surface 16, and a second outer layer of durable abrasion-resistant material 24. In preferred form, the first inner layer 16 is made up of 1000 denier nylon cordura fabric, while the second outer layer 24 is preferably made up of heavy-duty nylon ballistic fabric. It should be understood, however, that any type of appropriate abrasion-resistant material may be utilized for the inner and outer layers 16, 24 of the unitary member 10.

In preferred form, the center portion 22 includes a central aperture 26 which is sized and shaped to permit a human head 28 to easily pass therethrough to position the vest member 10 over the torso of the individual wearer 12. The central aperture 26 divides the central portion 22 into respective right and left shoulder strap members 30, 32. The shoulder strap members 30, 32 include padding between the inner layer 16 and the outer layer 24 thereof so that the wearer 12 can comfortably carry the load imposed by the weight of the ballistic-resistant armor elements added to the vest 10 as described below. In addition, the front panel portion 18 includes a pair of laterally extending side panels 34, 36 along the lower area thereof to form closure flaps. Likewise, the back panel portion 20 includes a similar pair of laterally extending side panels 38, 40 along the lower area thereof to form closure flaps for interacting engagement with the side panels 34, 36 of the front panel portion 18 as described in greater detail below.

It is common in such tactical vests to attach a plurality of different types of auxiliary items and supply receptacles to the exterior surface thereof. For example, receptacles for small flashlights known as stingers are used. Moreover, receptacles for shotgun shells and M16 or handgun magazines are also common. In addition, large flashlight holders, gas mask pouches, and small arms holsters are also commonly attached. Frequently, these items are permanently affixed to the exterior of such vests thereby preventing a wearer from modifying the location as well as the types of such receptacles in accordance with his particular needs and desires or tactical requirements. However, the present invention is adapted to permit maximum flexibility in the variation of size, number and location of such auxiliary items and supply receptacles on the vest 10 of the invention.

Figure 7:
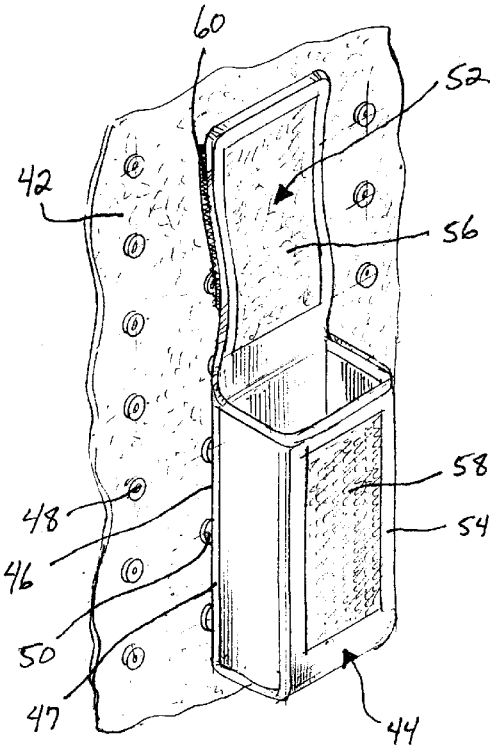
FIG. 7 is a perspective view of a typical ammunition supply receptacle secured to the vest of the present invention and having a top flap constructed for selective attachment in an open position.

In order to accomplish this significant flexibility and variability in attaching receptacles or other items to the vest 10, the outer surface of the second layer 24 of both the front panel portion 18 and the rear panel portion 20 as well as a substantial surface area of the shoulders 30, 32 are all covered by a layer of attachment fabric 42. In preferred form, the attachment fabric 42 is the form of hook-and-loop type fastening fabric commonly known under the trademark Velcro. The supply receptacles such as illustrated at 44 include the complimentary or mating fastening fabric 46 of the hook-and-loop type fastening members on its backside 47 as illustrated in FIG. 7. In this manner, any type of supply receptacle or other auxiliary item that is desired to be attached to the vest 10 can be positioned along any location of the rear or back panels 18, 20, respectively, by simply securing the fastener fabric 46 to the fastener fabric 42.

In order to further securely fasten such detachable elements 44 to the vest 10, a plurality of individual fastening members 48 are spaced across the entire fabric 42 so as to form a modular attachment grid between the fasteners 48 and the fastener fabric 42. In preferred form, the fasteners 48 are in the form of one of a pair of complementary or mating snap-fastener members, the mating portion or members 50 being disposed on the surface 47 of the receptacle element 44. In preferred form, the fasteners 48 are caps or buttons spaced approximately two inches apart. In this manner, the fastening members 50, which are the mating posts for the caps 48, and the fastening fabric 46 of the receptacle element 44 are securely attachable to the fastening members 48 and fastening fabric 42 along the vest 10 at any desired location. This arrangement also provides a significant advantage with respect to the receptacles 44. The receptacles 44, in any typical form, generally include a flap cover 52 which is secured to the container portion 54 by mating hook-and-loop type fastener strips 56, 58. In a police or military situation, it is undesirable to have such flaps 52 flopping loosely about once they have been opened. Therefore, a layer 60 of hook-and-loop type fastening fabric is attached to the upper surface of the flap 52. Consequently, when the flap 52 is opened, the fabric 60 secures itself to the attachment fabric 42 and keeps the flap 52 in its open position until it is desired to selectively close the receptacle 44 by disengaging the attachment fabric 60 from the attachment fabric 42.

As indicated above, such tactical vests are commonly worn over body armor which is first positioned on the torso of the wearer. The present invention obviates the necessity for multiple layers of ballistic-resistant vests or items. This is accomplished by providing means within the vest 10 for selectively storing assorted types of ballistic resistant elements. In preferred form, and referring in particular to FIGS. 3–6, the front panel portion 18 includes a first interior compartment 62 which is defined between the first inner layer 16 and the second outer layer 24 of the front panel portion 18. Disposed within the compartment 62 are a plurality of pouches 64. In preferred form, there are three pouches 66, 68 and 70. Each of these three pouches 66, 68 and 70 are sized and shaped to removably carry different types of ballistic-resistant body armor elements to provide ballistic protection to the wearer 12 of the vest 10.

In preferred form, the first pouch 66 is sized to carry a ceramic shield, preferably a 40-pound ceramic shield. The last pouch 70 is the largest and is positioned immediately against the inner layer 16. This pouch 70 is designed to carry soft body armor such as Kevlar and the like. Interposed between these two pouches 66 and 70 is a smaller pouch 68 which is preferably sized and shaped to carry steel trauma plates. More specifically, two steel plates approximate 6"×9" and 8.5"×10.5" are placed within the pouch 68. The pouch 68 is located within the first interior compartment 62 so that the steel plates contained therein cover the heart area of the wearer 12. The pouches are preferably accessed through an opening 72 in the outer surface of the front panel portion 18. The opening 72 is preferably a quick release opening in a form of a zipper closure. However, any type of closure may be utilized for the opening 72.

The rear panel portion 20 preferably includes a second interior compartment 74 which is defined between the first inner layer 16 and the second outer layer 24 of the rear panel portion 20. The second interior compartment 74 is preferably accessed through an opening 76 disposed in the first inner layer 16 of the back surface of the rear panel portion 20. In preferred form, the opening 76 is likewise a quick release closure opening, although it is preferably in the form of a hook-and-loop type closure for comfort as compared to the zippered closure of the opening 72. As in the first interior compartment 62, the second interior compartment 74 includes a plurality of pouches 64. In preferred form, there are two pouches 78 and 80 which are designed to carry a variety of different assorted ballistic-resistant body armor elements. In the preferred embodiment, the pouch 78 carries a ceramic shield similar to that carried in the first interior compartment 62, while the larger second pouch 80 carries soft body armor such as Kevlar and the like.

As a result of the above arrangement of pouches 64 within each of the front and rear panel portions 18, 20, a user or wearer 12 of the vest 10 can put together any type of arrangement of ballistic-resistant body armor elements he chooses depending upon his perceived needs and desires as well as the tactical requirements he faces. Consequently, the desired ballistic-resistant body armor elements can be selected and positioned within the vest 10 so that the vest 10 is then ready to be worn at a moment's notice without having to put on a plurality of different layers, since the body armor is already in place within the vest 10. Moreover, a plurality of detachable elements such as supply receptacles or auxiliary items 44 and the like can be positioned on the vest 10 at predetermined locations desired by the wearer prior to use. Thus, the vest 10 is completely ready in situations where a police or military person needs to act quickly, and the items attached to the vest 10 can be changed by the wearer at the slightest opportunity as needed.

The vest 10 is attached to a wearer by an individual inserting his head 28 within the opening 26 so that the front portion 18 is positioned against his chest while the rear portion 20 is positioned against his back. To assist in firmly attaching the vest 10 in place, the side panels or closure flaps 38, 40 of the rear panel portion 20 include an elastic-containing waist strap 82. More specifically, the waist strap 82 includes a first strap portion 84 mounted to the closure flap 38 and a second strap portion 86 mounted to the closure flap 40. The first strap portion 84 includes a base 87 attached to the closure flap 38, an elastic member 88 and an attachment member 90 having a layer of attachment fabric, preferably hook-and-loop type fabric 92, attached thereon. Likewise, the second strap portion 86 includes a base member 94 attached to the closure flap 40, an elastic portion 96 and an attachment member 98 which includes a layer of attachment fabric 100, such as hook-and-loop fabric, on the opposite side thereof. In this manner, when the vest 10 is placed over the head 28 of a wearer 12, the first and second strap portions 84, 86 are stretched to secure the attachment members 90 and 98 about the waist of the user 12. This is particularly illustrated in FIG. 2. Thus, the rear panel portion 20 of the vest 10 is securely mounted in place on the wearer 12.

Figure 2:
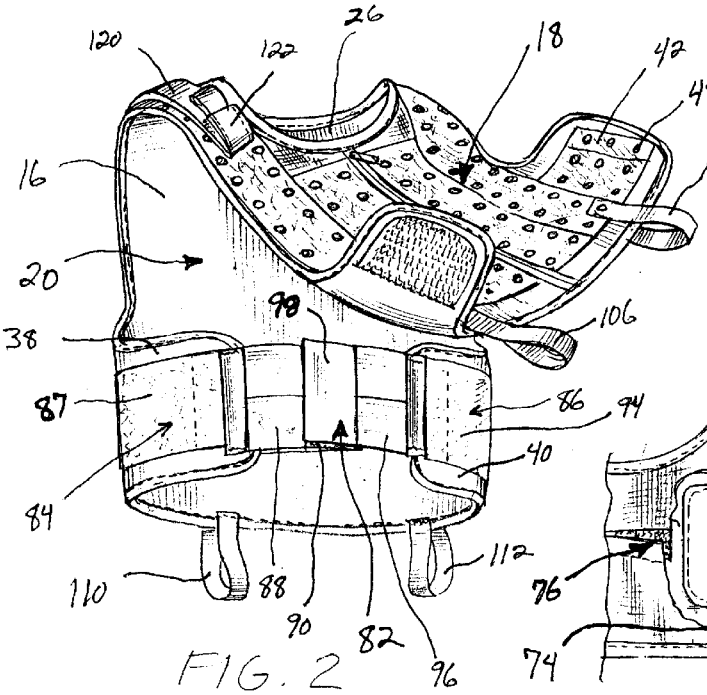
FIG. 2 is a front perspective view similar to that illustrated in FIG. 1 but showing the vest in a partially attached position but without the individual wearer.
Figure 6:
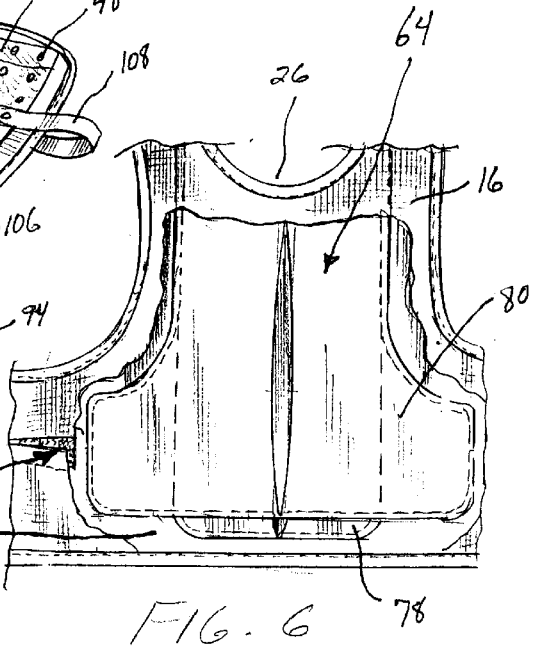
FIG. 6 is a rear plan view, with parts broken away, of the rear panel of a vest constructed in accordance with the present invention and illustrating the second interior compartment and the pouches disposed therein for containing ballistic-resistant body armor elements.
Figure 3:
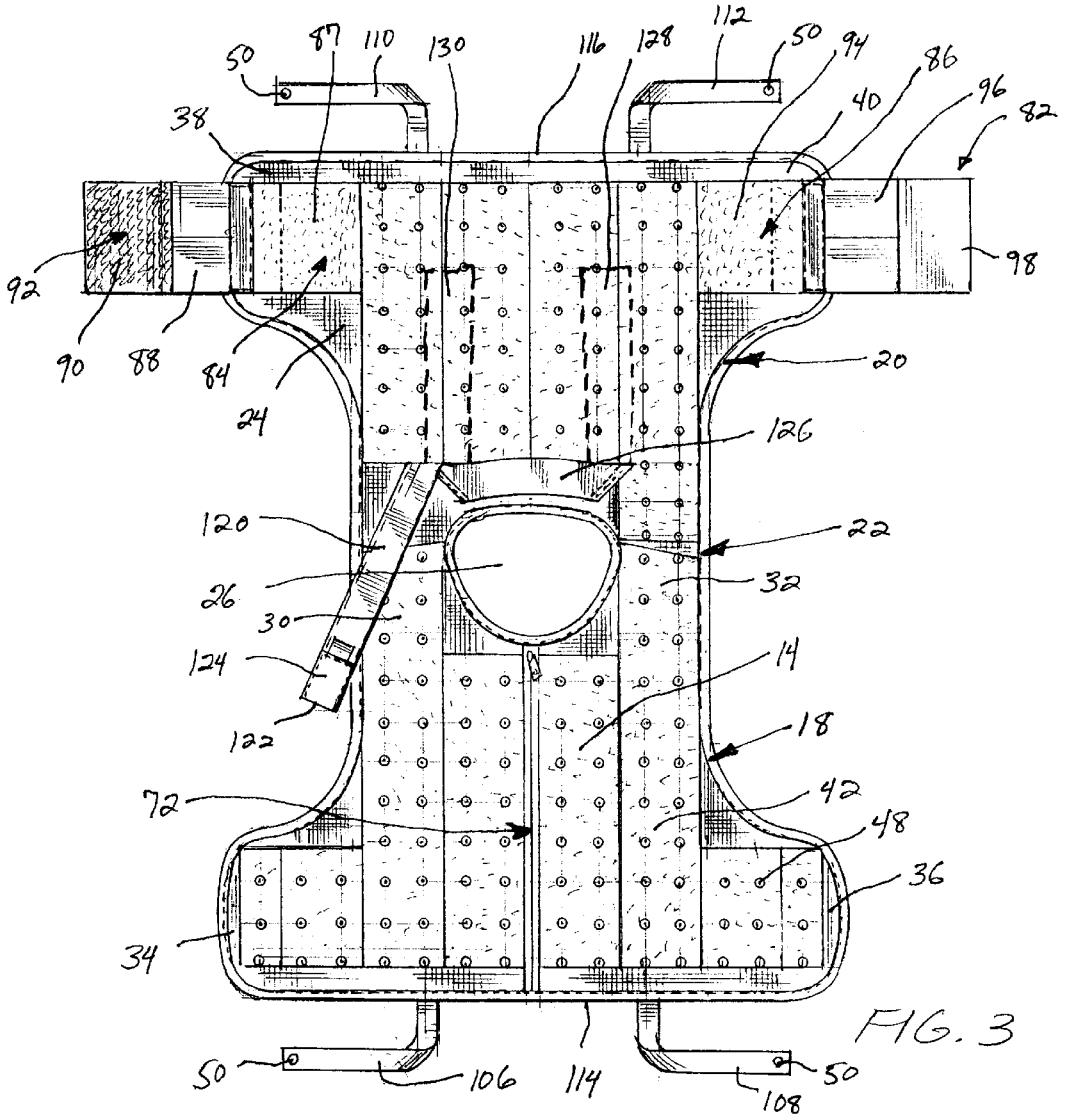
FIG. 3 is a plan view illustrating the outer surface of the vest of FIG. 1 in a laid-out flat position.
Figure 5:
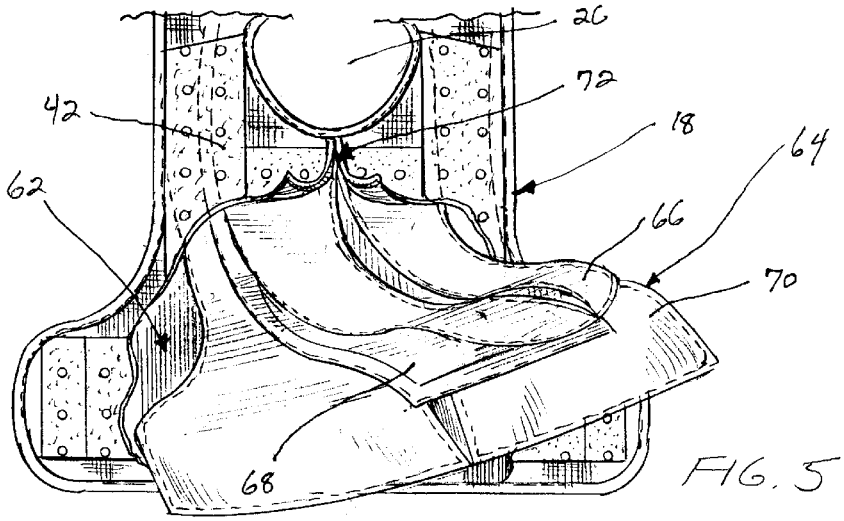
FIG. 5 is a front perspective view, with parts broken away, of the front panel of a vest constructed in accordance with the present invention and illustrating the first interior compartment and the pouches disposed therein for containing ballistic-resistant body armor elements.
Figure 4:
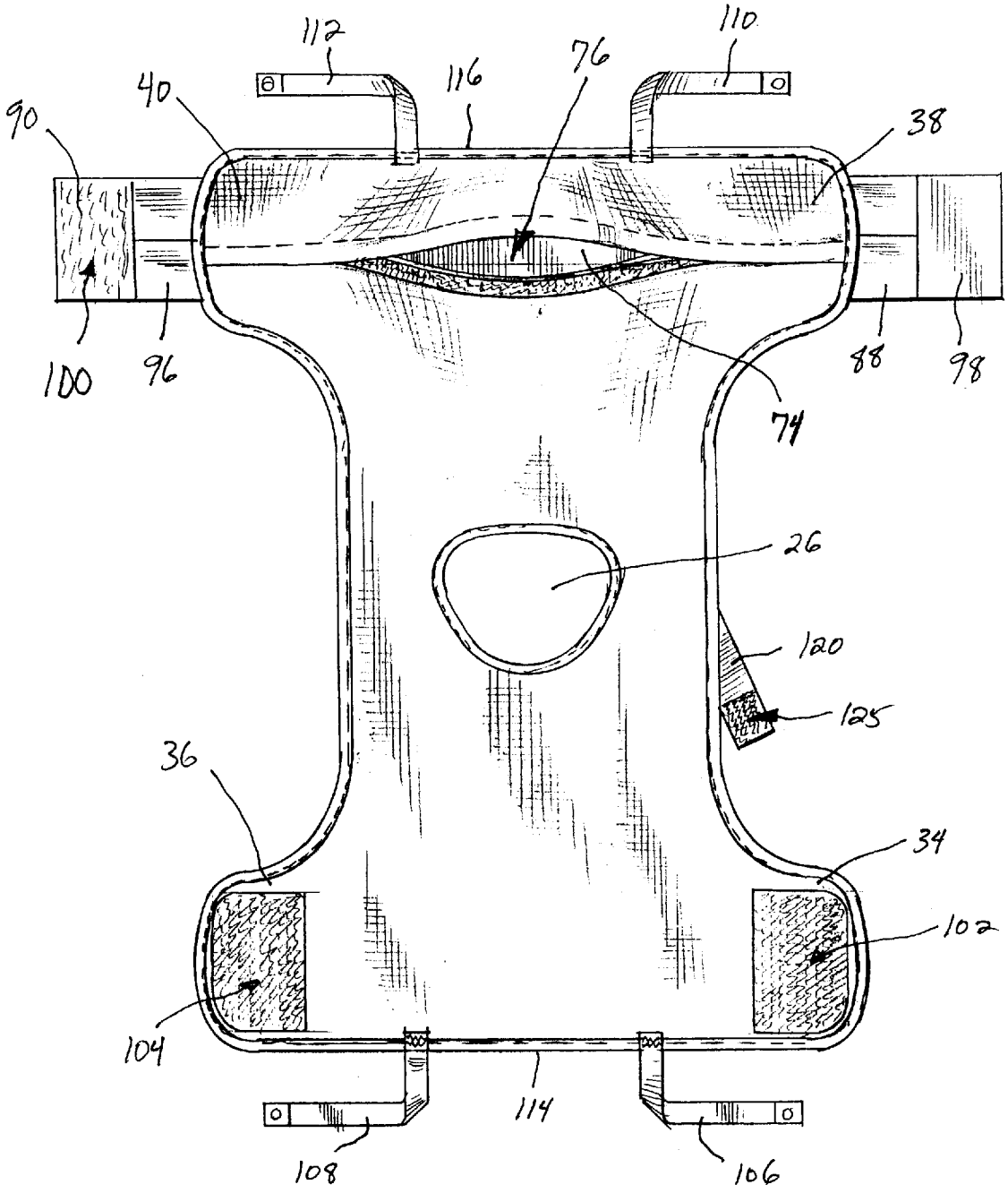
FIG. 4 is a view substantially the same as FIG. 3 but illustrating the inner surface of the vest of the invention.

In order to complete the attachment of the vest 10 to the wearer 12, the inner surfaces of the front panel closure flaps 34, 36 each include a patch of fastening fabric 102, 104, respectively. The fastening fabric 102, 104 is preferably a hook-and-loop type fabric. Likewise, the outer surfaces of the base members 87 and 94 of the waist strap 82 also include patches of mating or cooperative fastening fabric. Therefore, once the waist strap 82 is in place about a wearer 12 as indicated in FIG. 2, the fastening or Velcro patches 102, 104 of the side panels 34, 36 are secured to the fastening fabric or Velcro patches of the base members 87 and 94 on the side panels 38, 40 to provide an entire side wrap area as indicated in FIG. 1. As a result, there is a double waist attachment of the vest 10 to the wearer 12 in the form of the waist strap 82 and the interconnection of the front panel side flaps 36, 34 with the rear panel side flaps 38, 40. This arrangement of the present invention firmly secures the vest 10 to the user 12.

In addition to the above vest attachment mechanism, the vest 10 is also anchored and secured to the wearer 12 utilizing a plurality of anchor straps 106, 108 and 110, 112. The anchor straps 106, 108 are permanently affixed along the lowermost edge 114 of the front panel portion 18. Likewise, the anchor straps 110, 112 are permanently affixed to the lowermost edge 116 of the rear panel portion 20. Each anchor strap 106–112 preferably includes a fastening member 50 disposed at the distal end thereof for attachment to a fastening member 48 on the vest 10. In this manner, the anchor straps 106–112 can be looped through a service belt 118 worn by the user 12. Once the anchor straps 106–112 are looped through the belt 118, they can be tightly cinched and then secured to the vest 10 by interconnection of the fastening member portions 48, 50 at any desired position on the vest 10. As a result of the synergistic interaction of the anchor straps 106–112, the waist strap 82 and the interconnection of the front panel side flaps 36, 34 with the rear panel side flaps 38, 40, the vest 10 of the present invention remains firmly fixed about a user 12 once it is put into position.

The central portion 22 of the vest 10 preferably includes a tubular strap 120 that projects down between the fastening fabric 42 and the second outer layer 24 and extends outwardly to a distal end 122. The distal end 122 includes a closure flap 124 and a strip of Velcro fabric 125 that enables the distal end 122 to be secured to the shoulder strap 30. This tubular member 120 is provided for the storage and easy access of flex cuffs. In addition, an officer recovery strap 126 is positioned laterally across the central portion 22 immediately adjacent the opening 26. The recovery strap 126 is typically utilized to pull a fallen individual out of close quarters or harm's way. The ends 128, 130 of the officer recovery strap 126 preferably project downwardly along the rear panel portion 20 between the fastening fabric 42 and the second outer layer 24. These projecting ends 128, 130 are firmly attached to the ballistic fabric 24 and the inner layer fabric 16 to provide a firm mounting for the officer recovery strap 126. Moreover, the projecting ends 128, 130 and the officer recovery strap 126 are arranged so that the strap 126 normally lies flat against the surface of the central panel portion 22 immediately adjacent the opening 26. In this manner, the strap 126 has substantial strength so that the individual 12 may be pulled out of harm's way, yet the strap 126 does not stick out from the surface of the vest 10 so as to inadvertently catch on projecting objects.

As can be seen from the above, the present invention provides a load bearing protective vest for military and police applications wherein the individual using the vest must be protected from small arms fire and the like. The vest of the present invention is arranged so that a wide variety of assorted and different types of ballistic-resistant body armor elements may be incorporated therein as desired or required by the individual using the vest. These particular body armor elements may be mixed and changed by individual as that individual's tactical needs or desires change. Moreover, the vest of the present invention also enables maximum variation of the placement of detachable elements such as supply receptacles and other articles, weapons or ammunition magazines onto the vest as desired by the individual using the vest. This is accomplished through a unique modular attachment grid system that virtually covers the entire outer surface of the vest of the invention, thereby allowing an individual wearing the vest to personalize the types and positions of various items attached to the vest. This individualization of the ballistic-resistant armor elements as well as the releasably attached receptacles or auxiliary items with the vest of the present invention may very well be dictated depending upon the tactical situation being faced by the military or police officer. Thus, maximum flexibility and diversity of the present invention is a substantial improvement and advantage. Finally, the present invention is designed to be easily and quickly put on while simultaneously firmly fixed in position without riding-up on the officer's back or chest. This provides substantial comfort to the individual using the vest of the present invention.

The foregoing description and the illustrative embodiments of the present invention have been described in detail in varying modifications and alternate embodiments. It should be understood, however, that the foregoing description of the present invention is exemplary only, and that the scope of the present invention is to be limited to the claims as interpreted in view of the prior art. Moreover, the invention illustratively disclosed herein suitably may be practiced in the absence of any element which is not specifically disclosed herein.

I claim:

1. A load-bearing protective tactical vest adapted to selectively retain body armor elements and carry detachable elements such as supply receptacles and auxiliary items, said vest comprising:

a unitary member having a front panel, a rear panel and a central panel interconnecting said front and rear panels, each said panel having at least a first inner layer of durable abrasion-resistant material and a second outer layer of durable abrasion-resistant material;

said central panel defining a center opening sized and shaped for receiving a human head therethrough and a pair of shoulder support straps disposed on each side of said center opening adapted to support a load imposed by said vest during use thereof;

a layer of attachment fabric in the form of hook-and-loop type fastening means covering a substantial portion of the outer surface of said second outer layer material of each said front and rear panels, the detachable elements carrying a complementary hook-and-loop type fastening means;

a plurality of individual fastening members spaced across a substantial portion of said attachment fabric in operative relation therewith for selective placement and attachment of the detachable elements to the outer surface of said vest;

said front panel having a first interior compartment defined between said first and second layers of material, said first compartment being accessible through a first vest opening;

said rear panel having a second interior compartment defined between said first and second layers of material, said second compartment being accessible through a second vest opening;

a plurality of at least two individual pouches secured within said first compartment and accessible through said first vest opening for selectively receiving variable sized and types of ballistic-resistant body armor elements to provide selectively variable front ballistic protection to a user of said vest; and a plurality of at least two individual pouches secured within said second compartment and accessible through said second vest opening for selectively receiving variable sized and types of ballistic-resistant body armor elements to provide selectively variable rear ballistic protection to a user of said vest.

2. The vest as claimed in claim 1, wherein said first interior compartment includes at least three of said pouches, and wherein said second interior compartment includes at least two of said pouches.

3. The vest as claimed in claim 2, wherein one of the pouches of said first compartment is sized and shaped to receive a soft body armor element, wherein a second one of the pouches of said first compartment is sized and shaped to receive a ceramic shield element, and wherein a third one of the pouches of said first compartment is sized and shaped to receive a steel trauma plate element.

4. The vest as claimed in claim 3, wherein said third one of said pouches of said first compartment is sized and shaped to receive a pair of steel trauma plate elements sized and positioned for location directly over the heart area of a user.

5. The vest as claimed in claim 2, wherein one of the pouches of said second compartment is sized and shaped to receive a soft body armor element, and wherein a second one of the pouches of said second compartment is sized and shaped to receive a ceramic shield element.

6. The vest as claimed in claim 1, wherein said first vest opening is located in said second outer layer of durable abrasion-resistant material of said front panel and includes a quick release closure member.

7. The vest as claimed in claim 1, wherein said second vest opening is located in said first inner layer of durable abrasion-resistant material of said rear panel and includes a quick release closure member.

8. The vest as claimed in claim 1, wherein each said front and rear panel includes an upper portion proximate said central panel and a lower portion distal from said central panel, and wherein the lowermost edge of the lower portion of said front and rear panels each includes a pair of anchor straps secured thereto and sized for looping through a belt of a user during the wearing thereof.

9. The vest as claimed in claim 1, wherein each said front and rear panel includes an upper portion proximate said central panel and a lower portion distal from said central panel, and wherein the lower portion of each said front and rear panel includes laterally projecting side flaps for proximate placement about the waist of a user of said vest, and wherein each laterally projecting side flap of the lower portion of said rear panel includes an elastic extension band terminating in a quick release attachment member to form an elastic waist strap for selectively securing the projecting side flaps of said rear panel about the waist of a user of said vest.

10. The vest as claimed in claim 9, wherein the laterally projecting side flaps of each of said front and rear panels include quick release fastening members for selectively connecting the laterally projecting side members of said front panel to the laterally projecting side members of said rear panel.

11. The vest as claimed in claim 1, wherein said central panel includes a recovery strap handle disposed laterally across the junction area of said central panel and said rear panel proximate said center opening, said recovery strap handle being positioned flat against the surface of said vest and including a pair of extension elements projecting along said rear panel between said second outer layer of material and said layer of attachment fabric, said extension elements being tightly affixed to said second outer layer of abrasion-resistant material to anchor said recovery strap handle to said vest without said strap handle projecting outwardly therefrom.

12. The vest as claimed in claim 1, wherein said individual fastening members comprise one of a pair of mating portions of a plurality of snap fasteners wherein each said snap fastener includes complementary mating portions in the form of a post portion and a button portion, the remaining complementary mating portions for said fastening members being disposed on said detachable elements.

13. The vest as claimed in claim 1, wherein each said detachable element includes a container portion and a removable cover flap, each said cover flap including a fastening member in the form of a mutually co-operable hook-and-loop type fastening means for engaging said attachment fabric to selectively maintain said cover flap in an open position once opened.

14. The vest as claimed in claim 1, wherein said vest further includes anchor elements depending therefrom for attachment proximate the waist of a user during the wearing of said vest.

15. The vest as claimed in claim 1, wherein said detachable elements each include a receptacle portion and a quick-release cover portion, said cover portion including fastening means for engaging said attachment fabric to selectively maintain said cover portion in an open position once released and opened.

16. A ballistic resistant garment particularly useful in military and police applications and adapted to selectively carry detachable supply receptacles having container portions with quick release cover portions for carrying items useful in said military and police applications, said garment comprising:

a unitary poncho-like member having a front portion adapted for positioning over the chest area of a user, a rear portion adapted for positioning over the back area of a user, and a center portion for positioning over the shoulder area of a user, said unitary member including a first inner layer of durable abrasion-resistant material and a second outer layer of durable abrasion-resistant material;

a pair of load-bearing shoulder support portions formed in said center portion on either side of a central aperture sized and shaped for receiving a human head therethrough;

an attachment grid disposed over a substantial portion of the outer surface of the second outer layer of durable abrasion-resistant material of said front and rear portions to permit selective placement and attachment of said detachable supply receptacles;

a first interior compartment defined in said front member portion between said first and second layers of durable abrasion-resistant material, said first interior compartment being accessible through a first garment opening;

a second interior compartment defined in said rear member portion between said first and second layers of durable abrasion-resistant material, said second interior compartment being accessible through a second garment opening;

supply receptacles having quick release cover portions including fastening means for engaging said attachment grid to selectively maintain said cover portions in an open position once released and opened; and a plurality of at least two individual containment pouches disposed within each said first and said second interior compartments, said pouches being sized and shaped to selectively receive variable sized and types of ballistic-resistant elements therein to provide selectively variable front and rear ballistic protection to a user of said garment.

17. The ballistic resistant garment as claimed in claim 16, wherein said attachment grid comprises a substantially continuous layer of attachment fabric in the form of hook-and-loop type fastening means covering a substantial portion of each said front and rear member portions, the detachable supply receptacles carrying a complementary hook-and-loop type fastening means for detachable attachment thereto, and a plurality of fastening members in the form of one of a pair of complementary mating portions of individual fastening members spaced in grid fashion across a substantial portion of said attachment fabric in operative relation therewith for selective placement and attachment of the detachable supply receptacles to the outer surface of said garment, the remaining complementary mating portions for said fastening members being disposed on said detachable supply receptacles.

18. The ballistic resistant garment as claimed in claim 16, wherein said first interior compartment includes at least three of said pouches sized and shaped to receive a soft body armor element, a ceramic shield element and a steel trauma plate element, and wherein said second compartment includes at least two of said pouches sized and shaped to receive a soft body armor element and a ceramic shield element.

19. The ballistic resistant garment as claimed in claim 18, wherein the third pouch of said first compartment is sized and positioned therewith in for locating said steel trauma plate element directly over the heart area of the user of said garment.

20. The ballistic resistant garment as claimed in claim 16, wherein each said front and rear member portion includes an upper section proximate said center member portion and a lower section distal from said center member portion, wherein the lower section of each said front and rear member portion includes laterally projecting closure flaps to form side wrapping areas about the waist of a user of said garment, wherein each laterally projecting closure flap of the lower section of said rear member portion includes an elastic extension band terminating in a quick release attachment member to form an elastic waist strap for selectively securing the projecting closure flaps of said rear member portion about the waist of a user of said garment, and wherein the laterally projecting closure flaps of each of said front and rear member portions include quick release fastening members for selectively connecting the laterally projecting closure flaps of said front member portion to the laterally projecting closure flaps of said rear member portion after the attachment of said elastic waist strap to form said side wrapping areas.

21. The ballistic resistant garment as claimed in claim 20, wherein the lowermost edge of the lower section of each said front and rear member portion includes a pair of anchor straps secured thereto and sized for looping through a belt of a user during the wearing of said garment.

22. In a load-bearing tactical vest for military and police protective use adapted to selectively carry detachable supply receptacles thereon and including front and rear panels made from at least two layers of durable abrasion-resistant material, a central compartment in each of said front and rear panels sized to contain ballistic resistant body armor, strips of attachment fabric in the form of hook-and-loop type fastening means covering portions of the outer surface of said front panel, a plurality of individual fastening members spaced across said attachment fabric in operative relation therewith for selective placement and attachment of the detachable supply receptacles to the outer surface of said vest, the detachable supply receptacles carrying complementary hook-and-loop type fastening means, and a recovery strap handle disposed on the upper portion of the rear panel, the improvement comprising:

said vest having a center portion interconnecting said front and rear panels for positioning the vest over the shoulder area of a user, said center portion defining a central opening sized and shaped for receiving a human head therethrough and a pair of shoulder support straps disposed on each side of said central opening adapted to support a load imposed by said vest during use thereof;

a first interior compartment defined in said front panel between said layers of durable abrasion-resistant material, said first interior compartment being accessible through a first vest opening;

a second interior compartment defined in said rear panel between said layers of durable abrasion-resistant material, said second interior compartment being accessible through a second vest opening;

a plurality of at least two individual pouches secured within said first interior compartment and accessible through said first vest opening for selectively receiving variable sized and types of ballistic-resistant body armor elements to provide selectively variable front ballistic protection to a user of said vest; and a plurality of at least two separate and distinct individual containment pouches disposed within said second interior compartment to selectively receive variable sized and types of assorted ballistic-resistant elements therein to provide selectively variable rear ballistic protection to a user of said vest.

23. The improvement as claimed in claim 22, wherein said first interior compartment includes at least three of said pouches sized and shaped to receive a soft body armor element, a ceramic shield element and a steel trauma plate element, and wherein said second compartment includes at least two of said pouches sized and shaped to receive a soft body armor element and a ceramic shield element, the third pouch of said first compartment being sized and positioned therewithin for locating said steel trauma plate element directly over the heart area of a user of said vest.

24. The improvement as claimed in claim 23, wherein said first vest opening is located in the outer layer of durable abrasion-resistant material of said front panel and includes a quick release closure member disposed in the front surface thereof, and said second vest opening is located in the inner layer of durable abrasion-resistant material of said rear panel and includes a quick release closure member.

25. The improvement as claimed in claim 22, wherein said attachment fabric and fastener members are in the form of an attachment grid disposed over substantially all of the outer surface of the outer layer of durable abrasion-resistant material of said front and rear panels to permit selective placement and attachment of said detachable supply receptacles.

26. The improvement as claimed in claim 25, wherein said center portion includes a recovery strap handle disposed laterally across the junction area of said center portion and said rear panel proximate said central opening, said recovery strap handle being positioned flat against the surface of said vest and including a pair of extension elements projecting along said rear panel between the outer layer of material and said layer of attachment fabric, said extension elements being tightly affixed to said outer layer of abrasion-resistant material to anchor said recovery strap handle to said vest without said handle projecting outwardly therefrom.

27. The improvement as claimed in claim 22, wherein each said front and rear panel includes an upper portion proximate said central opening and a lower portion distal from said central opening, and wherein the lower portion of each said front and rear panel includes laterally projecting side closure flaps for proximate placement about the waist of a user of said vest, and wherein each laterally projecting side flap of the lower portion of said rear panel includes an elastic extension band terminating in a quick release attachment member to form an elastic waist strap for selectively securing the projecting side closure flaps of said rear panel about the waist of a user of said vest.

28. The improvement as claimed in claim 27, wherein the laterally projecting side closure flaps of each of said front and rear panels include quick release fastening members for selectively connecting the laterally projecting side closure flaps of said front panel to the laterally projecting side closure flaps of said rear panel about the closed elastic waist strap.

29. The improvement as claimed in claim 22, wherein each said front and rear panel includes an upper portion proximate said central opening and a lower portion distal from said central opening, and wherein the lowermost edge of the lower portion of said front and rear panels each includes a pair of anchor straps adjustably secured thereto and sized for looping through a belt of a user during the wearing thereof.

30. The improvement as claimed in claim 22, wherein each said supply receptacle includes a container portion and a removable cover flap, each said cover flap including a fastening member in the form of a mutually co-operable hook-and-loop type fastening means for engaging said attachment fabric to selectively maintain said cover flap in an open position once opened.

31. A load-bearing protective tactical vest adapted to selectively carry detachable elements such as supply receptacles and auxiliary items, said vest comprising:

a unitary member having a front panel, a rear panel and a central panel interconnecting said front and rear panels, each said panel having at least a first inner layer of durable abrasion-resistant material and a second outer layer of durable abrasion-resistant material;

said central panel defining a center opening sized and shaped for receiving a human head therethrough and a pair of shoulder support straps disposed on each side of said center opening adapted to support a load imposed by said vest during use thereof;

a layer of attachment fabric in the form of hook-and-loop type fastening means covering a substantial portion of the outer surface of said second outer layer material of each said front and rear panels, the detachable elements carrying a complementary hook-and-loop type fastening means;

a plurality of individual fastening members spaced across a substantial portion of said attachment fabric in operative relation therewith for selective placement and attachment of the detachable elements to the outer surface of said vest;

anchor elements depending from said vest for attachment proximate the waist of a user during the wearing of said vest;

said front panel having a first interior compartment defined between said first and second layers of material, said first compartment being accessible through a first vest opening;

said rear panel having a second interior compartment defined between said first and second layers of material, said second compartment being accessible through a second vest opening;

a plurality of individual pouches secured within said first compartment and accessible through said first vest opening; and a plurality of individual pouches secured within said second compartment and accessible through said second vest opening, said pouches of said first and second compartments being sized and shaped for selectively receiving assorted ballistic-resistant body armor elements for providing ballistic protection to a user of said tactical vest.

* * * * *